United States Patent [19]

Lombard

[11] 4,372,368

[45] Feb. 8, 1983

[54] BLOCKING APPARATUS FOR FIXING A METAL BLOCK TO THE FINISHED FACE OF A SEMI-FINISHED SPECTACLE LENS BLANK

[75] Inventor: Gérard Lombard, Velaines, France

[73] Assignee: Essilor International (Compagnie Generale d'Optique), France

[21] Appl. No.: 191,130

[22] Filed: Sep. 26, 1980

[30] Foreign Application Priority Data

Sep. 26, 1979 [FR] France ..... 79 23922

[51] Int. Cl.[3] ..... B22D 19/00

[52] U.S. Cl. ..... 164/332; 164/344; 425/808

[58] Field of Search ..... 164/98, 112, 332, 344, 164/334; 425/808

[56] References Cited

U.S. PATENT DOCUMENTS

| | | | |
|---|---|---|---|
| 3,049,766 | 8/1962 | Buckminster | 164/112 X |
| 3,221,378 | 12/1965 | Faas et al. | 164/334 |
| 3,383,808 | 5/1968 | Deshayes et al. | 164/112 X |
| 3,507,076 | 4/1970 | Rudd et al. | 164/332 X |
| 3,563,301 | 2/1971 | McCall et al. | 164/332 |
| 3,804,153 | 4/1974 | Tagnon | 164/332 |
| 3,951,203 | 4/1976 | Prumer | 164/112 X |

*Primary Examiner*—Gus T. Hampilos

[57] ABSTRACT

This blocking apparatus for fixing a metal block to the finished face of a semi-finished spectacle lens blank by casting a low-melting metal into a mold contacting the finished face of the blank comprises a mold made of two sections, namely a fixed section and a movable section, the former carrying the annular seat for the lens blank and the latter carrying relief elements, these two mold sections being in mutual rotary contact through part-spherical surfaces constituting a ball-joint centered to the axis of the annular seat. Control means are operatively connected to a shaft rigid with the movable mold portion for orienting same and cause same to be lipped about the center of the ball-joint in order to impart the prescribed prism value and the prescribed prism axis orientation, and align the relief elements with the prescribed cylinder axis.

17 Claims, 10 Drawing Figures

BLOCKING APPARATUS FOR FIXING A METAL BLOCK TO THE FINISHED FACE OF A SEMI-FINISHED SPECTACLE LENS BLANK

BACKGROUND OF THE INVENTION

The present invention relates to a blocking apparatus for fixing a metal block to the finished face of a semi-finished spectacle lens blank, by casting according to a known technique a low-melting metal into a mold contacting the finished blank surface, which comprises a housing, an open mold supported by said housing and having a fixed section and a movable section arranged for rotary contact with the fixed mold section, one of said mold sections comprising an annular seat adapted to support the finished blank face, while the other mold section comprises relief elements capable of forming positioning reference marks in said metal block, said relief elements defining a system of three orthogonal axes, said system having a first axis coincident with a central axis of said annular seat in an initial position of the movable mold section, and a second axis adapted to be brought into alignment with a prescribed cylinder axis contemplated for a semi-finished lens blank, means associated with said housing for holding the blank on said annular seat and means associated with said housing for casting a low-melting metal into a cavity defined by said open mold through a casting duct formed in the mold.

The blocking apparatus according to the present invention is particularly convenient for blocking semi-finished blanks of spectacle lenses to be subsequently finished with a prescribed prismatic correction. In this case, it is particularly significant that the metal block utilized for fixing the semi-finished blank to the work mandrel of the machine to be subsequently used for shaping the other face of the lens be secured very accurately to the finished face of the lens blank so that when shaping said other face the prescribed amount of prism, measured in terms of prismatic diopters, be introduced into the lens and that the prism axis be set on the selected meridian. Moreover, if the spectacle lens has to be finished with a cylindrical correction, i.e. when the second face of the lens must be a true toric surface or have a toric character, the cylinder axis must likewise be set on the selected meridian, which differs mostly from the meridian selected for the prism axis.

Blocking apparatus capable of performing these various operations are already known in the art. Thus, a typical apparatus is disclosed in the French Pat. No. 2.253.605. In this known apparatus the relief elements are carried by the fixed section of the mold and the annular seat which is to receive the finished face of the blank is formed on the movable mold section consisting of a pair of prismatic rings provided with circular graduated scales registering with another circular graduated scale carried by the frame structure of the apparatus for adjusting the prism value and the prism axis orientation to the prescribed values. To set the prism value to the desired magnitude, one of the two rings is rotated with respect to the other ring, and to adjust the prism axis orientation to the desired value the two rings are rotated as a unit in relation to the frame structure. When these adjustment steps are completed, the blank is placed on the annular seat and reference marks previously made on the finished blank face are brought into proper alignment with diametrally opposed marks formed on the relief elements. Now, this alignment operation is particularly difficult to carry out successfully since the marks are observed through the blank and the latter lies in a skew position with a prism axis generally not coincident with the diametral line interconnecting the reference marks. Under these conditions, parallax effects and refraction effects from the blank proper mark this alignment operation a particularly awkward one, often resulting in a wrong centering of the optical axis of the blank in relation to the central reference mark and in a faulty angular position of the blank in relation to the diametral line interconnecting the reference marks.

As a rule, semi-finished blanks for spectacle lenses are delivered by the manufacturer with marks traced on the finished face for designating the optical center and one of the two vertical and horizontal axes for mounting the lens in the spectacles, generally the horizontal diameter. Moreover, as a rule, the corrections for prism and cylinder as prescribed by the oculist are marked in relation to one of the two mounting vertical and horizontal axes, usually the horizontal diameter; in other words, the angular positions of the prism axis and cylinder axis are marked in relation to this horizontal diameter.

Now, in the known blocking apparatus disclosed in the above-mentioned French Pat. No. 2.253.605, due to the particular principle on which this apparatus is based, the prism axis is oriented with respect to the cylinder axis which must be marked beforehand on the finished face of the lens blank and which, during the above-mentioned alignment operation, must be aligned with the diametral line carrying the reference marks. Therefore, this involves an additional marking step for designating the cylinder axis. Furthermore, for setting the orientation of the prism axis, what must be displayed on the graduated circular scale carried by the frame structure is not the angular value prescribed by the oculist (this value being given in relation to the horizontal diameter) but the difference between the angular values prescribed by the oculist for the cylinder axis and prism axis, or in other words the value of the angle formed between these two axes. This obviously constitutes a contraint for the operator of the apparatus and a risk of additional error.

In addition, due to the specific conception of the blocking apparatus disclosed in the above-mentioned French patent, a full automation of the operations consisting in setting the prism angle value, the prism axis orientation, the cylinder axis orientation, and positioning the semi-finished blank on the annular seat can hardly be contemplated. Finally, in the known blocking apparatus, the low-melting point fused metal is cast through the bottom of the mold, (uphill casting), and therefore the molten metal must be supplied thereto under pressure.

SUMMARY OF THE INVENTION

It is the primary object of the present invention to provide an improved blocking apparatus of the type broadly set forth above for fixing a metal block to the finished face of a semi-finished spectacle lens blank, in which the causes of positioning errors of the blank in relation to the mold reference marks are eliminated to a substantial extent if not completely. It is another object of this invention to provide an improved blocking apparatus of the above-defined type wherein the whole or part of the adjustment operations can be performed automatically, if desired.

For this purpose, in the blocking apparatus according to this invention the annular seat is formed on the fixed mold section, the relief elements are carried by the movable mold section, the fixed and movable sections of the mold have cooperating partially spherical surfaces defining a ball-joint connection center of rotation of which lies on the central axis of the annular seat in close vicinity of the center of said seat, the movable mold section being rigidly attached to a shaft with the shaft having a longitudinal axis coincident with the central axis of said annular seat in the initial position of said movable mold section, the shaft axis extending along a direction remote from said annular seat, control means coupled to said shaft are provided for orienting and tipping said movable mold portion about the center of rotation of said ball-joint connection in order to define a mold cavity for forming a metal block having a prescribed prism value and a desired orientation of the prism axis, and to align said relief elements with the desired cylinder axis.

Since the annular seat is formed on the fixed mold section, the semi-finished blank can be placed on the annular seat before carrying out the prism angle adjustment, prism axis orientation and cylinder axis orientation operations. Therefore, the operation consisting in aligning the blank reference marks with the marks carried by the relief elements proper carried by the movable mold section can be carried out before the above-mentioned adjustment operations, so that the optical effects resulting from the tipped blank position, which interfered with this alignment operation in the known blocking apparatus, are eliminated completely in the apparatus of the present invention.

According to a preferred embodiment of the present invention, the operation consisting in centering the blank and aligning the reference marks with the corresponding fixed lines can be carried out without having to observe these marks and lines through the lens blank. To this end, the fixed mold section may advantageously be provided with a cylindrical peripheral rim surrounding concentrically the annular seat and have an inner diameter corresponding to the outer diameter of the blank, in order to ensure a perfect centering of the optical center of the blank in relation to the annular seat and also to a central mark carried by the movable mold section. Moreover, this cylindrical rim may advantageously be provided with a fixed mark, so that a mark formed on the peripheral edge of the blank can be caused to register with said fixed mark in order to obtain the desired alignment in relation to the reference marks carried by the movable mold section. In all cases, the alignment operation is accomplished by utilizing a mark designating one of the two vertical and horizontal lens mounting axes, usually the horizontal axis. Thus, and since the relief elements constituting the reference mounting marks on the mandrel of the machine subsequently used for grinding the other face of the lens are carrier by the movable mold section, the prism axis orientation is adjusted not in relation to the cylinder axis but in relation to the horizontal mounting diameter, i.e. by using the data given by the oculist. Under these conditions, it is unnecessary to carry out a preliminary step for marking the blank in order to designate the cylinder axis, and to calculate the angle between the prism axis and the cylinder axis from the data supplied by the oculist.

Moreover, as will be explained presently, the blocking apparatus may be provided with manual control means or automatic control means.

Other features and advantages of the blocking apparatus of this invention will appear as the following detailed description proceeds with reference to the accompanying drawings illustrating diagrammatically typical and preferred embodiments of the invention, given by way of example, not of limitation.

THE DRAWINGS

DESCRIPTION OF THE PREFERRED EMBODIMENTS

Figure 1:
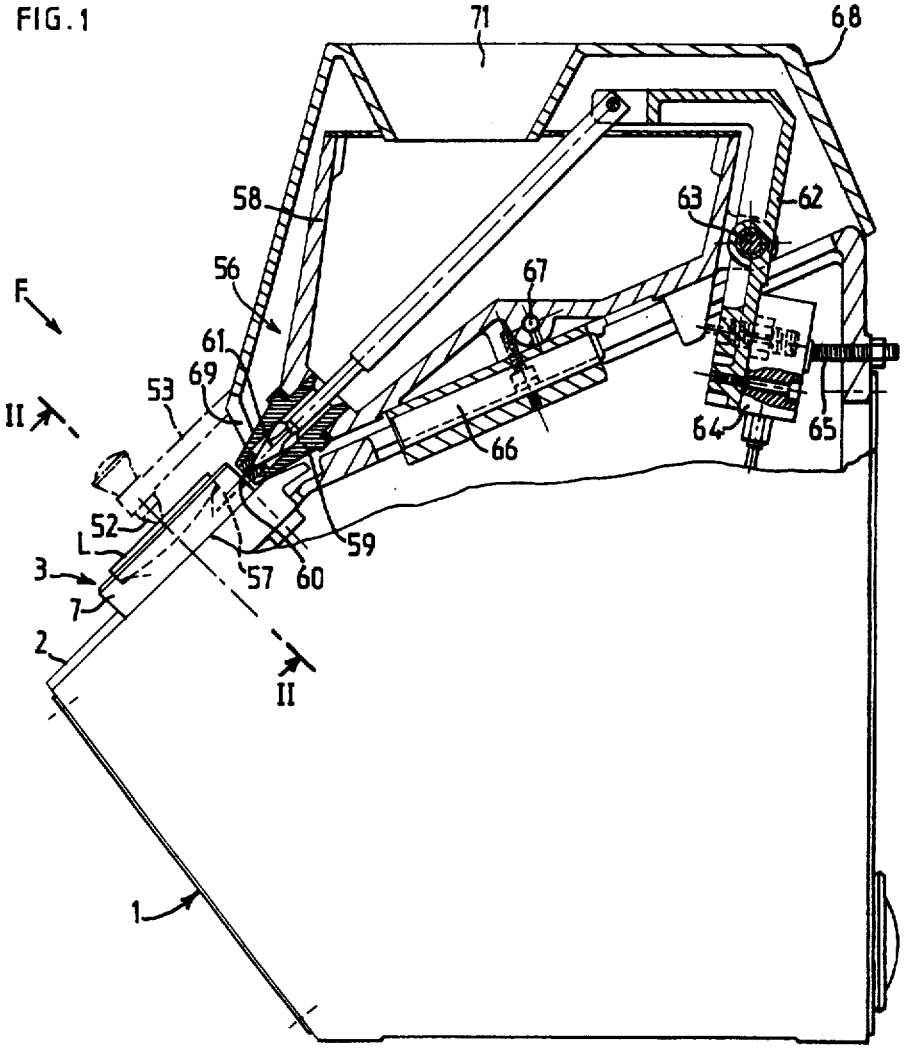
FIG. 1 is a part-elevational, part-sectional view of the blocking apparatus of the present invention.
Figure 3:
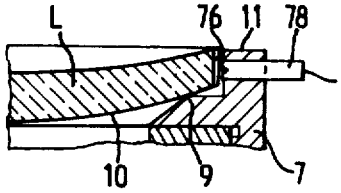
FIG. 3 is a fragmentary section showing a detail on a larger scale.

The blocking apparatus illustrated in FIGS. 1 to 5 of the drawings comprises a housing 1 of which the top plate 2 supports a mold 3. This mold 3 comprises essentially a fixed section 4 and a movable section 5 held in rotary contact with the fixed section 4.

Figure 4:
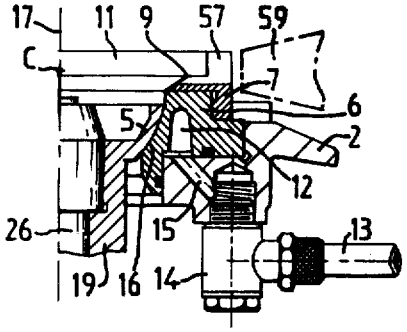
FIG. 4 is another detail view also in fragmentary section.
Figure 2:
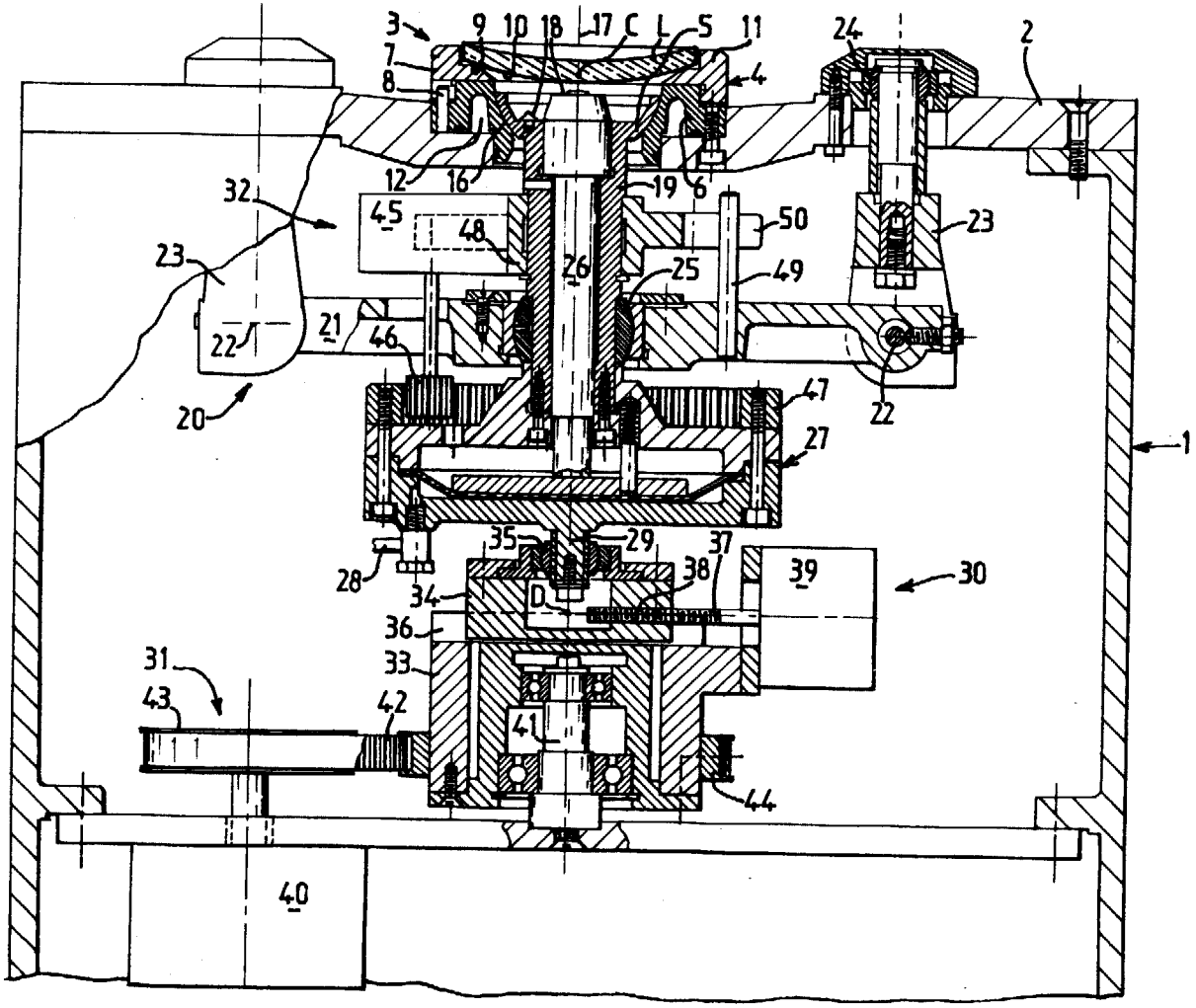
FIG. 2 is a section taken on a larger scale along the line II—II of FIG. 1.

As illustrated in FIG. 2, the fixed mold section comprises preferably a first ring 6 secured in an aperture provided for this purpose in the top plate 2, and a second ring 7 mounted coaxially and detachably on the first ring 6. A stud 8 is provided for fixing the angular position of the second ring 7 in relation to the first ring 6. This second ring 7 comprises an annular seat 9 adapted to receive the finished face 10 of a semi-finished lens blank L, and a cylindrical outer peripheral rim 11 surrounding concentrically the annular seat 9 and having an inner diameter corresponding to the outer diameter of the lens blank L. The second ring 7 is interchangeable with other similar rings of which the peripheral rims 11 have inner diameters corresponding to the outer diameters of the various commercially available lens blanks L. The first ring 6 has formed therein an annular groove or passage 12 connected to a source of cooling fluid (not shown) via a pipe 13, a union 14 and a hole 15 formed through the top plate 2 of the housing, as shown in FIG. 4.

The rotary contact between the ring 6 and the movable section 5 of mold 3 is obtained by means of cooperating partially spherical surfaces 16 formed on the ring 6 and on the movable mold section 5 and defining a ball-joint connection having its center of rotation C lying on the central axis 17 of annular seat 9 in close vicinity of the center of said seat. The movable mold section 5 carries relief elements, for example two protrusions 18 projecting into the mold cavity. These relief elements 18 define a system of three orthogonal reference axes, of which a first axis is coincident with said axis 17 of annular seat 9 and a second axis is aligned with the two aligned elements 18. These relief elements 18 are adapted to form in the metal block to be subsequently cast in the mold 3 (as will be explained presently) means for positioning and mounting said metal block, together with the lens blank L attached thereto, on the mandrel or spindle of the grinding machine to be used in a later step for shaping the second face of blank L.

As shown in FIG. 2, a shaft 19 is rigidly attached to the movable section 5 of mold 3. This shaft 19 extends along a direction remote from the annular seat 9 and its longitudinal axis is coincident with the axis 17 of the annular seat when the movable mold section 5 is in its initial position shown in FIG. 2.

In order to keep the partially spherical surfaces 16 of the movable mold section 5 and ring 6 in mutual contact, the shaft 19 is connected to the top plate 2 of housing 1 by means of a jointed coupling 20. As shown in FIG. 2, this jointed coupling 20 comprises a rocker 21 having each end thereof pivotally connected by means of a pivot pin 22 to the arms of a fork 23 (see also FIG. 10). Each fork 23 is suspended from the top plate 2 by means of a ball-joint connection 24. Intermediate its ends, the rocker 21 is coupled with shaft 19 by means of another ball-joint connection 25 locked in the axial direction on shaft 19. The shaft 19 can revolve in this ball-joint connection 25.

The shaft 19 comprises an axial bore (FIG. 2) opening into the cavity of the movable mold section 5 and having an ejection rod 26 slidably mounted therein. To eject the metal block and the lens blank L attached thereto, the ejection rod 26 can be moved upwards by an actuator 27 consisting, for example of a diaphragm-type pneumatic cylinder to which compressed air can be supplied via a hose 28 connected to a source of compressed air (not shown). The body of this actuator 27 is secured coaxially to the shaft 19 and comprises at its lower portion a cylindrical projection 29 constituting an extension of shaft 19. The ejection rod 26, in its retracted position shown in FIG. 2, protrudes into the mold cavity and constitutes one of the pair of relief elements 18.

Three control means 30, 31 and 32 are associated with shaft 19 for orienting and tipping this shaft 19 and the movable mold section 5 about the center C of the ball-joint connection formed by said partially spherical surfaces 16.

The control means 30 is adapted to tip the shaft 19 by an angle corresponding to a predetermined or prescribed prism value about said center C in the plane containing the axis 17 and the second axis of the above-mentioned system of three orthogonal axes, this second axis being aligned with the diametrally aligned relief elements 18. The control means 30 is carried by a support 33 rotatably mounted in the housing 1 about an axis coincident with the seat axis 17, and comprises a carriage 34 coupled to the shaft extension 29 through a ball-joint connection 35 arranged for axial sliding movement on said shaft extension 29, a slideway 36 formed on said support 33 for guiding the carriage 34 in a direction parallel to said second axis of the system of three axes, a lead-screw 37 drivingly engaged in a tapped hole 38 formed in said carriage 34, and an electric step-by-step motor 39 secured to said support 33 for rotatably driving the lead-screw 37 and thus move the carriage 34 along the slideway 36. Thus, when the angular value of each step of motor 39, the pitch of lead-screw 37 and the distance between points C and D are known, it is possible to tip the movable section 5 of mold 3 about point C through an angle corresponding to the prescribed prism value by simply allowing the motor 39 to rotate through the proper number of steps.

The control means 31 is coupled to the support 33 in order to cause the latter to rotate about the axis 17 through an angle corresponding to a desired or prescribed orientation of the prism axis. This control means 31 comprises another electric step-by-step electric motor 40 drivingly coupled to support 33. As shown in FIG. 2, this support 33 is rotatably mounted on an arbor 41 secured to the housing 1 coaxially to the axis 17 and it is rotatably driven from motor 40 by means of a cogged belt 42 passing over a pair of cogged pulleys 43 and 44 keyed to the shaft of motor 40 and to support 33, respectively. Of course, any other transmission means may be used for transmitting the movement of rotation from motor 40 to support 33. It is also possible to mount the motor 40 coaxially to the seat axis 17 and to couple the support 33 directly to the shaft of motor 40. As the angular value of each step of motor 40 and the transmission ratio of the driving means possibly provided between the motor 40 and support 33 are known, this support 33 and the control means 30 may be driven to revolve about the axis 17 through an angle corresponding to the prescribed orientation of the prism axis by causing the shaft of motor 40 to rotate through a suitable number of steps.

The control means 32 is adapted to cause the shaft 19 to rotate about its axis by an angle corresponding to a desired or prescribed orientation of the cylinder axis by bringing the relief elements 18 into proper alignment with the desired or prescribed cylinder axis. As shown in FIG. 2, the control means 32 comprise a third step-by-step motor 45 driving a toothed pinion 46 meshing with an internally toothed wheel 47 secured to the body of the pneumatic actuator 27 concentrically to shaft 19. This third motor 45 is secured to a support 48 mounted concentrically to shaft 19 and held against rotation with said shaft 19 by a pin 49 secured to the rocker 21 and engaging between the two arms of a fork 50 integral with said support 48. Thus, when the angular value of each step of motor 45 and the transmission ratio of gears 46 and 47 are known, it is possible to cause the shaft 19 to rotate through an angle corresponding to the prescribed orientation of the cylinder axis by allowing the motor 45 to perform the suitable number of steps.

It will be seen that digital signals applied to the three motors 39, 40 and 45 respectively for performing the three necessary adjustments, i.e. the adjustment of the prescribed prism value, the adjustment of the prescribed orientation of the prism axis and the adjustment of the prescribed orientation of the cylinder axis, may advantageously be derived from a computer to which the data corresponding to the optical characteristics prescribed by the oculist are entered by means of a conventional computer keyboard. Under these conditions, the above-mentioned adjustments can be obtained in a fully automatic manner.

Figure 5:
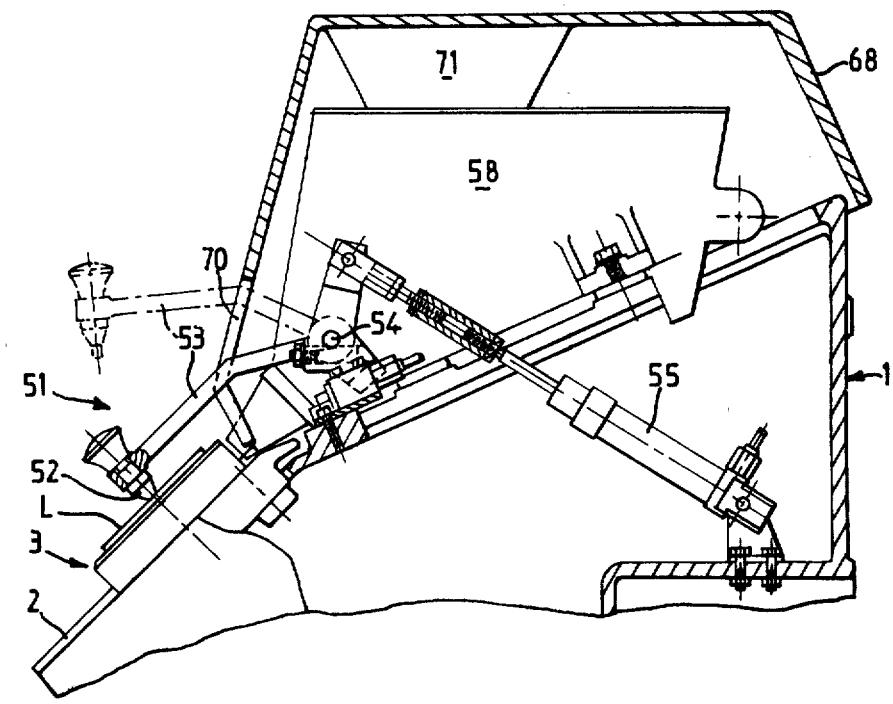
FIG. 5 is a fragmentary cross-section showing the means provided for holding the lens blank on its annular seat.

The blocking apparatus further comprises a device 51 for holding the lens blank L on the annular seat 9 of mold 3. As shown in FIG. 5, this holding device 51 comprises a holding member proper 52 mounted to one end of an arm 53 adapted to pivot about a pin 54 between an inoperative position in which said arm is spaced from the mold 3 (shown in dash and dot lines in FIG. 5) and an operative position (shown in thick lines in FIG. 5) in which the holding member 52 bears against the unfinished face of the lens blank L, substantially in the central area thereof. An actuator 55 such as a single-acting pneumatic cylinder is coupled to said arm 53 so as to pivot same from its inoperative position to its operative position when compressed air is supplied to actuator 55. A return spring (not shown) is provided for moving the arm 53 back to its inoperative position when the cylinder of actuator 55 is vented to the atmosphere.

The blocking apparatus further comprises a casting device 56 for pouring low-melting metal into the cavity formed between the mold 3 and the finished face 10 of lens blank L through a casting duct 57 formed in mold 3. As illustrated in FIG. 1, the top plate 2 of housing 1 is inclined to a relatively pronounced angle to the horizontal and the casting duct 57 is formed radially through the ring 7 at the uppermost point of its outer periphery (see also FIGS. 4 and 9). The casting device 56 overlies the casting duct 57 and comprises a molten-metal reservoir 58 secured to the top of housing 1 and provided at its lower portion with a casting nozzle 59 of which the outlet orifice 60 registers with the casting duct 57. A movable needle valve 61 is mounted in nozzle 59 for opening and closing at will the outlet orifice 60. This needle valve 61 is controlled by means of a lever 62 fulcrumed to a pin 63 and adapted to be actuated in the opening direction by an actuator 64, for example a single-acting pneumatic cylinder having its body secured to the lever 62 and reacting with its piston rod against the end of an adjustment screw 65 carried by the housing 1. The molten metal contained in reservoir 58 is kept at the proper temperature by means of electric heating resistances 66 to which electric current is supplied under the control of a heat probe 67 in order to keep the molten metal in reservoir 58 at a constant temperature.

Figure 9:
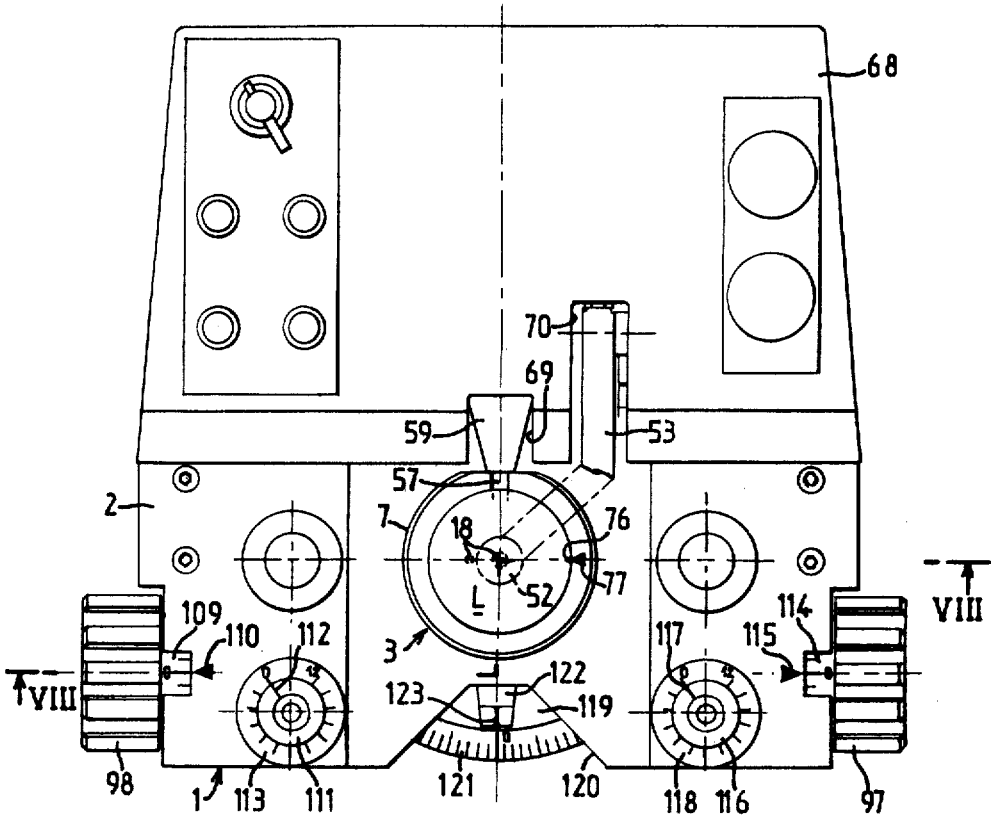
FIG. 9 is a view taken in the direction of the arrow F of FIG. 1, in case the control means of FIG. 8 were incorporated in the blocking apparatus.

As shown in FIGS. 1, 5 and 9 of the drawings, a cover 68 fitted over the upper portion of housing 1 is provided for protecting the casting device 56 and the holding device 51. This cover 58 has apertures 69 and 70 formed therein to permit the passage of the casting nozzle 59 and the blank holding arm 53 therethrough. The cover 68 further comprises in its upper portion funnel-shaped aperture 71 to permit the refilling of reservoir 58 with molten metal.

Figure 6:
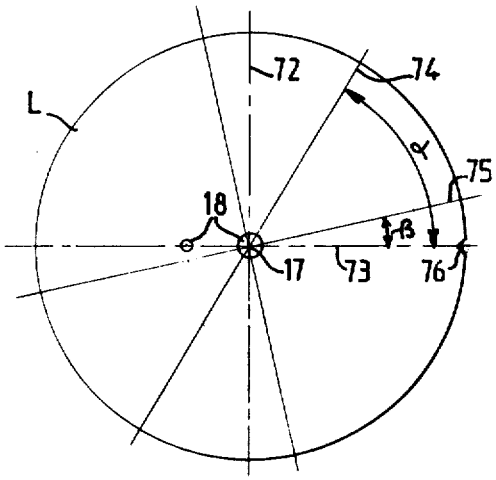
FIG. 6 shows an ophthalmic or spectacle lens with its horizontal and vertical mounting axes, a prescribed prism axis and a prescribed cylinder axis.

Now a typical sequence of operations for blocking a semi-finished spectacle lens blank by means of the above-described blocking apparatus will be described in detail. FIG. 6 shows a semi-finished blank L with its vertical axis 72 and its horizontal axis 73 corresponding to the mounting axes of the finished lens in a spectacle frame. The horizontal axis 73 is generally traced in a known manner by the lens blank manufacturer in the form of a line on the finished face of the lens blank L. It will be assumed that the other or unfinished face of blank L must be so shaped, in relation to the finished face, as to have a predetermined prism value, measured in prismatic diopters, with a predetermined orientation $\alpha$ of the prism axis 74. Moreover, it will be assumed that the other face of blank L has to be given a toric configuration with a cylinder axis 75 having a predetermined orientation $\beta$. As a rule, the angles $\alpha$ and $\beta$ prescribed by the oculist are marked in relation to the horizontal axis 73.

Initially, the movable section 5 of mold 3 and the shaft 19 are in the initial position shown in FIG. 2, and the arm 53 of holding device 51 is in the inoperative position shown in dash and dot lines in FIG. 5. Then the lens blank L is positioned on the annular seat 9 and perfectly centered to the axis 17 thereof by the cylindrical rim 11 of ring 7. The angular orientation of the lens blank L is subsequently adjusted by rotating the blank as necessary for aligning the horizontal axis 73 carried by the finished face 10 of the blank with the relief elements 18, as shown in FIG. 6. This alignment is an easy step since the blank L and the movable section 5 of mold 3 have not been tipped so far in relation to each other, so that any interfering optical effect is safely avoided. This alignment step may be further facilitated if a reference mark 76, for example in the form of a shallow notch (FIG. 6), is formed in the peripheral edge of blank L. As a rule, this notch 76 is cut beforehand by some lens blank manufacturers. In this case, it is only necessary to bring the mark 76 in proper registration with a fixed mark or arrow 77 formed on the peripheral edge 11 of ring 7, as shown in FIG. 9.

However, the positioning and orientation of the lens blank L on the annular seat 9 may be accomplished fully automatically by adhering to the following procedure. A transfer device of known type (not shown) is used for moving and holding the lens blank L to a short distance above the annular seat 9 and rotating slowly the blank about the axis 17. When the mark 76 moves past a detector 78 (FIG. 3) inserted through the peripheral rim 11 of ring 7, this detector emits a signal which is applied to means for stopping the slow rotation of the blank, and subsequently depositing this blank upon the annular seat 9 still by means of said transfer device.

With the lens blank L laid upon and properly oriented on the annular seat 9, the optical axis of the blank and its axes 72 and 73 are brought to their proper alignment or coincidence with the three axes of the reference system defined by the relief element 18.

Figure 7:
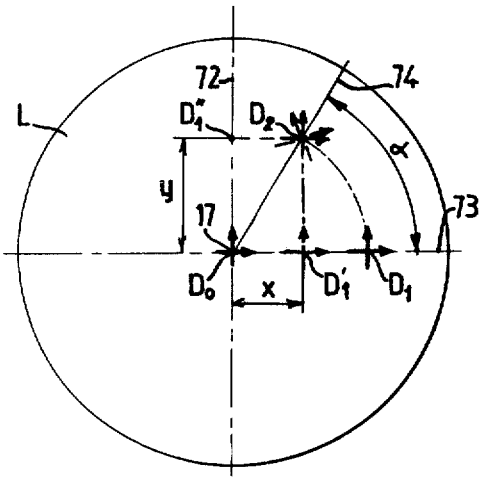
FIG. 7 is an explanatory diagram for better understanding the adjustments of the blocking apparatus illustrated in FIGS. 1-5 for blocking a spectacle lens having the prescribed prism axis and the prescribed cylinder axis shown in FIG. 6.

Then, the actuator 55 of holding device 51 is actuated in order to hold the blank L in position, and subsequently the motor 39 is energized by means of signal emitted from the computer so as to rotate through a number of steps corresponding to the data previously prescribed by the oculist, in order to tip the shaft 19 and the movable section 5 of mold 3 about the center C through an angle corresponding to the prescribed prism value. During this tipping movement, the point D of FIG. 2 is shifted from point $D_0$ to point $D_1$, as shown in FIG. 7; however, in this Figure this movement has been exaggerated considerably for the sake of clarity in the drawing.

Then, the motor 40 is energized by the computer and accomplishes a number of steps corresponding to the prescribed orientation of the prism axis 74, and consequently the support 33 and shaft 19 are caused to rotate about the axis 17 through an angle $\alpha$ corresponding to the prescribed orientation of the prism axis 74. During this movement of rotation, the point D of FIG. 2 describes a circular arc $D_1$, $D_2$ shown in FIG. 7.

Thereafter, the motor 45 is energized by the computer and rotated through a number of steps corresponding to the prescribed orientation of the cylinder axis 75, and as a consequence thereof the shaft 19 is rotated about its axis through an angle $\beta$ until the relief elements 18 are brought in proper alignment with the prescribed cylinder axis 75.

Then, the cylinder 64 of casting device 56 is actuated temporarily to open the needle valve 61 and allow molten metal to flow by gravity into the mold cavity through orifice 60 and casting duct 57, until the mold cavity is filled completely. When the metal in mold 3 has cooled down and set sufficiently, the cylinder 55 is vented to the atmosphere and a return spring moves the arm of holding device 51 back to its inoperative position. Finally, the diaphram-type actuator 27 is actuated to push the ejection rod 26 upwards and eject the metal block and the lens blank attached thereto out from the mold 3. The three motors 39, 40 and 45 are then reset to bring the movable section 5 of mold 3 back to its initial position in which it is ready for the next lens blank blocking cycle.

In the above-described blocking apparatus, it will be seen that the adjustment of the prism value to the desired magnitude is obtained by shifting the point D of FIG. 2 from $D_0$ to $D_1$, and that the adjustment of the orientation of the prism axis 74 is obtained subsequently by shifting the point D from $D_1$ to $D_2$ along a circular arc $\alpha$ centered at 17 as shown in FIG. 7. However, if desired these two adjustment operations may be carried out in the reverse order, i.e., one may firstly rotate the support 33 through an angle $\alpha$ by energizing the motor 40, and then shift point D from $D_0$ to $D_2$ by energizing the motor 39. Moreover, the orientation of the cylinder axis by means of motor 45 may be performed before or after the aforementioned two adjustment operations.

When considering the diagram of FIG. 7, it will also be seen that the prism value adjustment and the prism axis orientation adjustment may be carried out by firstly shifting said point D by a predetermined amount x, from $D_0$ to $D'_1$, and then by another predetermined amount y from $D'_1$ to $D_2$, or firstly by said amount y from $D_0$ to $D''_1$ and then by said amount x from $D''_1$ to $D_2$.

A modified embodiment of the blocking apparatus of this invention will now be described with reference to FIGS. 8–10 of the drawings, this modified version being based on this second adjustment method.

Figure 8:
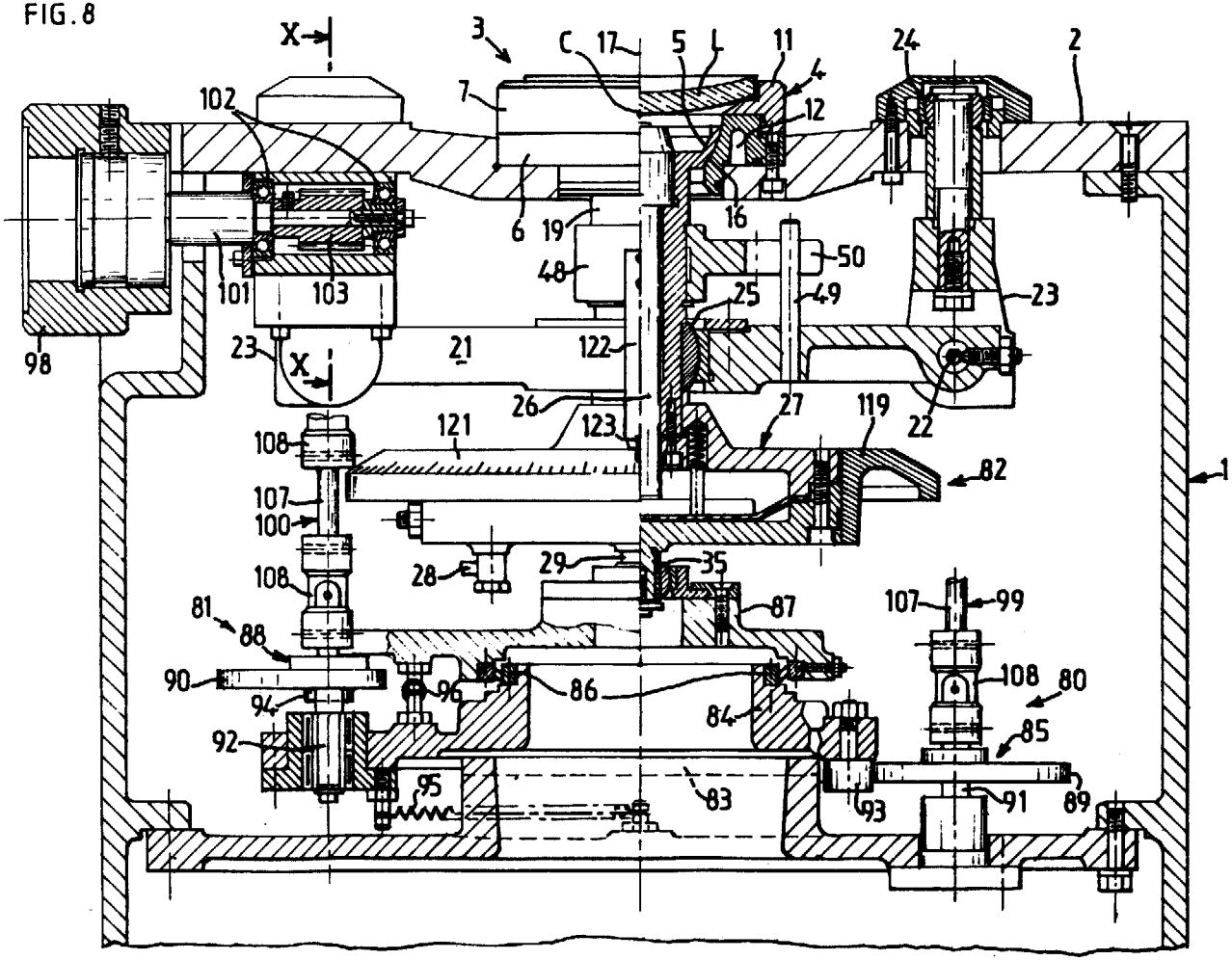
FIG. 8 is a view similar to FIG. 2 showing in section taken along the line VIII—VIII of FIG. 9 another embodiment of the control means incorporated in the blocking apparatus of the invention.
Figure 10:
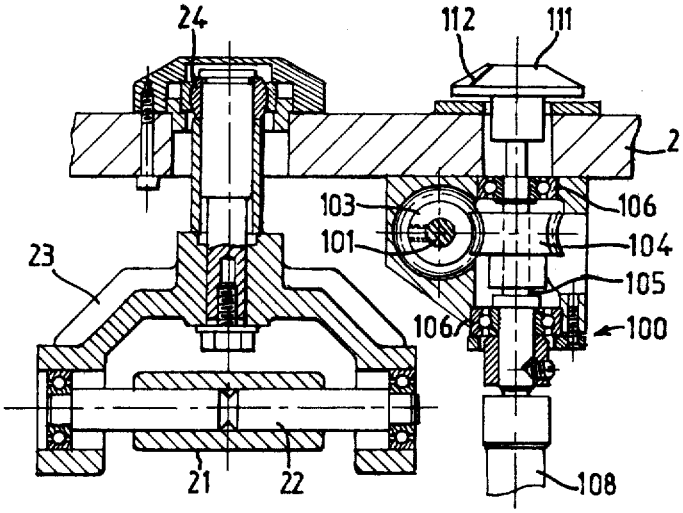
FIG. 10 is a fragmentary sectional view taken along the line X—X of FIG. 8 but on a slightly larger scale.

The blocking apparatus illustrated in FIGS. 8–10 has substantially the same structure as the blocking apparatus shown in FIGS. 1–5, except for the three control devices associated with shaft 19. Therefore, the component elements identical with those of the blocking apparatus shown in FIGS. 1 to 5 are designated with the same reference numerals and their detailed description is not deemed necessary.

The control device 30 of FIG. 2 is replaced by a control device 80 (FIG. 8) for tipping the shaft 19 about point C through an angle corresponding to the amount x (FIG. 7). Similarly, the control device 31 of FIG. 2 is replaced by a control device 81 (FIG. 8) for tipping the shaft 19 about the point C through an angle corresponding to the amount y (FIG. 7). Finally, the control device 32 of FIG. 2 is replaced by a control device 82 (FIG. 8) for rotating the shaft 19 about its axis through an angle $\beta$ corresponding to the prescribed orientation of the cylinder axis.

The control device 80 comprises a slideway 83 carried by the housing 1 and extending in a direction parallel to axis 73 (FIG. 7), i.e. in a direction parallel to the second axis of the system of three orthogonal axes described hereinabove, a carriage 84 movable along the slideway 83 and means 85 for driving the carriage 84 along the slideway 83. Similarly, the control device 81 comprises a slideway 86 carried by carriage 84 and extending in a direction parallel to the axis 72 (FIG. 7), i.e. in a direction parallel to the third axis of said three-axes system, a carriage 87 movable along slideway 86 and coupled to the extension 29 of shaft 19 by means of ball-joint connection 35, and means 88 for driving the carriage 87 along said slideway 86. Each one of the two drive means 85 and 88 comprises a cam 89 or 90, respectively, keyed or integral with a camshaft 91 or 92, respectively, parallel to axis 17, a roller follower 93 or 94, respectively, mounted on carriage 84 or 87, respectively, and urged for rolling contact with cam 89 or 90, respectively, by spring means 95 or 96, respectively, a rotary control knob 97 or 98, respectively, and transmission means 99 or 100, respectively, for transmitting the rotational movement of control knob 97 or 98 respectively to camshaft 91 or 92. Camshaft 91 is rotatably mounted in housing 1 laterally of carriage 84, and camshaft 92 is rotatably mounted on carriage 84 laterally of carriage 86.

The transmission means 99 and 100 are identical, and only the transmission means 100 is shown in detail in FIGS. 8 and 10. As illustrated in FIG. 8, the control knob 98 is fixed to a shaft 101 rotatably mounted in bearings 102 and having a helical gear 103 fixed thereto. This helical gear 103 is in constant meshing engagement with another helical gear 104 keyed to a shaft 105 rotatably mounted in bearings 106 (FIG. 10). Shaft 105 is operatively connected to camshaft 92 by means of a transmission shaft 107 and a pair of universal joints 108.

The control knob 98 is provided with a vernier 109 the graduated scale of which can be moved past a fixed reference mark 110 carried by the top plate 2 of housing 1 by rotating said knob 98 (FIG. 9). A wheel 111 keyed to the upper end of shaft 105 and projecting above said top plate 2 carries a reference mark 112 movable in front of a graduated scale 113 carried by said top plate 2 when the knob 98 is rotated. The divisions of scale 113 are disposed in such a manner that the mark 112 moves to the extent of one scale division when the knob 98 has accomplished a complete revolution. Similarly, the control knob 97 carries a graduated scale 114 movable past a fixed reference mark 115, and the rotation of knob 97 causes likewise a wheel 116 identical with wheel 111 to rotate, this wheel 116 carrying a reference mark 117 movable past a graduated scale 118 identical with the graduated scale 112.

The prism value and the prism axis orientation are set by rotating manually the control knob 97 until the amount x is displayed on scales 114 and 118 by reference marks 115 and 117, respectively, and by rotating the control knob 98 manually until the amount y be displayed on scales 109 and 113 by reference marks 110 and 112, respectively. The amounts x and y may be given for example by a double-entry table displaying for each conventional prism value and for values of angle $\alpha$ stepped for example in degrees the couple of values x, y to be displayed on graduated scales 114, 118, 109 and 113 for obtaining the prescribed prism value and the prescribed orientation of the prism axis 74. These amounts x and y may also be delivered by a suitably programmed computer.

As illustrated in FIG. 8, the control means 82 consists simply of a wheel 119 secured to the body of the pneumatic actuator 27 concentrically to the axis of shaft 19 and having a portion of the periphery thereof projecting through an aperture 120 formed in the wall of housing 1 (FIG. 9). This wheel 119 carries on its outer periphery a scale 121 graduated from 0 to 360 degrees. A plate 122 secured to support 48 carries a fixed reference mark 123 adjacent to the graduated scale 121. Thus, the prescribed orientation of the cylinder axis may be adjusted by rotating the wheel 119 manually until the line of graduated scale 121 corresponding to the desired angle $\beta$ registers with the fixed reference mark 123.

Though manually-operated control means 80, 81 and 82 have been provided in the blocking apparatus illustrated in FIGS. 8–10, it is possible to power these control means so that they operate fully automatically. Thus, for instance, control means 82 may be replaced by control means exactly similar to the control means 32 of FIG. 2. Moreover, both camshafts 91 and 92 may be driven for rotation by using separate electric step-by-step motors, either directly or through transmission means 99 and 100. In a similar way, the drive means 85 and 88 may consist if desired of screw and nut devices similar to the mechanism 37–39 of FIG. 2.

While the preferred structures in which the principles of the present invention have been incorporated are shown and described herein, it is to be understood that the invention is not to be limited to the particular details thus presented, but, in fact, different means may be employed in the practice of the broader aspects of this invention. The scope of the appended claims is intended to encompass all obvious changes in the details, materials and relative arrangements of parts which will occur to one of ordinary skill in the art upon a reading of this disclosure.

What is claimed as new is:

1. A blocking apparatus for fixing a metal block to the finished face of a semi-finished spectacle lens blank by casting low-melting metal into a mold contacting the finished face of the blank, which comprises:

(a) a housing, (b) an open mold supported by said housing and having a fixed section and a movable section arranged for rotary contact with said fixed section, said fixed mold section having an annular seat for supporting a finished blank face and said movable section having relief elements adapted to form positioning reference means in said metal block and to define a system of three orthogonal axes, said system having a first axis coincident with a central axis of said annular seat in an initial position of said movable mold section, and a second axis adapted to be brought into exact alignment with a prescribed cylinder axis for a semi-finished lens blank, the fixed and movable mold sections contact having cooperating partially spherical surfaces defining a ball-joint connection having its center of rotation lying on said central axis of the annular seat, the movable mold section being rigidly attached to a shaft with the shaft having a longitudinal axis coincident with the central axis of said annular seat in the initial position of said movable mold section, said shaft extending along a direction remote from said annular seat, (c) means associated with said housing for holding said lens blank on said annular seat, (d) casting means associated with said housing for delivering molten low-melting metal into a cavity defined by said open mold through a casting duct formed in said mold, (e) control means operatively connected to said shaft for orienting and tipping the movable mold section about said center of rotation of said ball-joint connection in order to define a mold cavity for forming a metal block having a prescribed prism value and a prescribed orientation of the prism axis and to align said relief elements with the prescribed cylinder axis.

2. The blocking apparatus of claim 1, wherein the fixed mold section is provided with a cylindrical peripheral rim surrounding concentrically said annular seat and having an inner diameter corresponding to the outer diameter of said lens blank.

3. The blocking apparatus of claim 2, wherein said cylindrical rim has formed thereon a fixed reference mark with which a mark formed on a peripherical edge of the lens blank is adapted to be brought into proper aligment.

4. The blocking apparatus of claim 2, wherein a detector capable of detecting a reference mark formed on the peripheral edge of the lens blank is mounted in said cylindrical rim.

5. The blocking apparatus of claim 2, wherein said fixed mold section comprises a first ring secured within an aperture formed in a top plate of said housing, said first ring comprising one of said cooperating partially spherical surfaces, and a second ring mounted coaxially and detachably to said first ring, said second ring comprising both said annular seat and said peripheral cylindrical rim.

6. The blocking apparatus of claim 5, wherein said top plate of said housing is substantially inclined to the horizontal, said casting duct being formed radially in said second ring at the uppermost level of its periphery, said casting means overlying said casting duct.

7. The blocking apparatus of claim 1, wherein said control means comprise a first control device operatively connected to said shaft for tipping said shaft through a first angle corresponding to said prescribed prism value about the center of rotation of said ball-joint connection in a plane containing said first and second axes of said system of three orthogonal axes, a support for supporting said first control device, said support being rotatably mounted in said housing about an axis merging with the central axis of said annular seat, a second control device operatively connected to said support for rotating said support about the central axis of said annular seat through a second angle corresponding to said prescribed orientation of the prism axis, and a third control device operatively connected to said shaft for rotating said shaft about its longitudinal axis through a third angle corresponding to said prescribed orientation of the cylinder axis.

8. The blocking apparatus of claim 7, wherein said first control device comprises a carriage having a tapped hole therein and coupled through another ball-joint connection to said shaft, said other ball-joint connection being arranged for axial sliding movement along said shaft, a slideway formed on said support for guiding said carriage in a direction parallel to the second axis of said system of three orthogonal axes, a lead-screw engaged in the tapped hole of said carriage and a first step-by-step electric motor secured to said support for rotatably driving said lead-screw and causing said carriage to travel along said slideway.

9. The blocking apparatus of claim 7, wherein said third control device comprises a second support mounted concentrically to said shaft and held against rotation with said shaft, a third step-by-step electric motor secured to said second support, a toothed pinion fixed to an output shaft of said third motor and a toothed wheel meshing with said pinion and fixed to said shaft.

10. The blocking apparatus of claim 7, wherein said second control device comprises a second step-by-step electric motor in driving relationship with said support.

11. The blocking apparatus of claim 10, wherein said support is rotatably mounted on a fixed arbor secured to said housing coaxially to the central axis of said annular seat, and said second control device comprises transmission means drivingly connecting said support with said second step-by-step motor.

12. The blocking apparatus of claim 1, wherein said control means comprise a first control device coupled to said shaft for tipping said shaft through a first angle corresponding to a first predetermined amount x about the center of rotation of said ball-joint connection in a first plane containing the first and second axes of said system of three orthogonal axes, a second control device coupled to said shaft for tipping said shaft through a second angle corresponding to a second predetermined amount y about said center of rotation of said ball-joint connection in a second plane containing the first and third axes of said system of three orthogonal axes, said first and second predetermined amounts x and y being combined to yield the prescribed prism value and orientation of the prism axis, and a third control device operatively connected to said shaft for rotating said shaft about its longitudinal axis through a third angle corresponding to a third angle corresponding to said prescribed orientation of the cylinder axis.

13. The blocking apparatus of claim 12, wherein said third control device comprises a control wheel fixed to said shaft and provided along its outer periphery with a graduated scale having division lines which correspond to angular values, a portion of the periphery of said control wheel projecting through an aperture formed in said housing, a second support mounted concentrically to said shaft and held against rotation with said shaft, and an index fixed to said second support and protruding into said aperture adjacent to the periphery of said control wheel.

14. The blocking apparatus of claim 12, wherein said first control device comprises a first slideway carried by said housing and extending in a direction parallel to said second axis of said system of three orthogonal axes, a first carriage movable along said first slideway and first drive means for moving said first carriage along said first slideway, and said second control device comprises a second slideway carried by said first carriage and extending in a direction parallel to said third axis of said system of three orthogonal axes, a second carriage movable along said second slideway and coupled to said shaft by means of another ball-joint connection arranged for axial sliding movement along said shaft, and second drive means for moving said second carriage along said second slideway.

15. The blocking apparatus of claim 14, wherein each one of said first and second drive means comprises a camshaft parallel to the central axis of said annular seat, a cam fixed to said camshaft, a roller follower mounted on the corresponding carriage, a spring urging said roller follover against said cam, a rotary control knob and a transmission means comprising gears and an articulated shaft for transmitting the movements of rotation of said rotary control knob to said camshaft, the camshaft of said first drive means being rotatably mounted in said housing laterally of said first carriage, the camshaft of said second drive means being rotatably mounted on said first carriage, and indicating means are are associated with each rotary control knob and with the transmission means connected thereto for displaying the value of said first amount x and of said second amount y, respectively.

16. The blocking apparatus of claim 1, wherein said shaft comprises an axial bore opening into the cavity of said movable mold section, a lens blank ejection rod is slidably mounted in said bore and a fluid-operated actuator is disposed in axial alignment with said shaft for actuating said ejection rod.

17. The blocking apparatus of claim 16, wherein said ejection rod, in its retracted position, projects into the mold cavity and constitutes one of said relief elements.

* * * * *